US007047738B2

(12) United States Patent
Bair

(10) Patent No.: US 7,047,738 B2
(45) Date of Patent: May 23, 2006

(54) HYDRAULIC SYSTEM FOR SYNCHRONIZED EXTENSION OF MULTIPLE CYLINDERS

(75) Inventor: Eugene C. Bair, Holland, MI (US)

(73) Assignee: JR Automation Technologies, LLC, Holland, MI (US)

( * ) Notice: Subject to any disclaimer, the term of this patent is extended or adjusted under 35 U.S.C. 154(b) by 0 days.

(21) Appl. No.: 10/894,713

(22) Filed: Jul. 20, 2004

(65) Prior Publication Data

US 2005/0172796 A1 Aug. 11, 2005

Related U.S. Application Data

(60) Provisional application No. 60/543,068, filed on Feb. 9, 2004.

(51) Int. Cl.
*F15B 7/00* (2006.01)

(52) U.S. Cl. ..... 60/546; 60/593

(58) Field of Classification Search ..... 60/546, 60/581, 593; 91/515
See application file for complete search history.

(56) References Cited

U.S. PATENT DOCUMENTS

| | | | | |
|---|---|---|---|---|
| 1,831,238 | A | | 11/1931 | Ferris |
| 2,499,563 | A | | 3/1950 | Bill |
| 2,983,256 | A | | 5/1961 | Seeloff |
| 2,997,849 | A | | 8/1961 | Shimanckas |
| 3,157,032 | A | | 11/1964 | Herpich |
| 3,257,810 | A | | 6/1966 | Hanni |
| 3,316,817 | A | | 5/1967 | Ellis |
| 3,590,581 | A | | 7/1971 | Bianchi |
| 3,625,115 | A | | 12/1971 | Shoichi Tani et al. |
| 3,643,725 | A | | 2/1972 | Fismer |
| 3,680,339 | A | | 8/1972 | Hayakawa |
| 3,769,881 | A | | 11/1973 | Aoki |
| 3,776,300 | A | | 12/1973 | Fismer |
| 3,783,620 | A | | 1/1974 | Moe |
| 3,832,852 | A | | 9/1974 | Schmucket |
| 3,855,794 | A | * | 12/1974 | Meyer et al. ..... 60/546 |
| 4,006,664 | A | | 2/1977 | Brown |
| 4,161,229 | A | | 7/1979 | Mifsud |
| 4,164,122 | A | | 8/1979 | Ward |
| 4,241,581 | A | | 12/1980 | Chace |
| 4,251,993 | A | | 2/1981 | Vancil |
| 4,351,153 | A | | 9/1982 | Kosmala |
| 4,585,172 | A | | 4/1986 | Gazzera |
| 4,624,126 | A | | 11/1986 | Avila et al. |
| 5,141,112 | A | | 8/1992 | Holbert |

(Continued)

*Primary Examiner*—Thomas E. Lazo
*Assistant Examiner*—Michael Leslie
(74) *Attorney, Agent, or Firm*—Price, Heneveld, Cooper, DeWitt & Litton LLP

(57) ABSTRACT

A lift table maintains levelness while lifting a support surface via two or more lift cylinder assemblies. A hydraulic circuit is connected to the cylinder assemblies, and includes synchronizer with multiple isolated chambers corresponding to the lift cylinder assemblies, a rod extending axially through the chambers, and pistons mounted on the rod and associated with the isolated chambers. An axial passageway extends continuously through the rod and is connected to first passageways for communicating hydraulic fluid to one side of the chambers. The hydraulic circuit operably connects a pump to the axial passageway of the synchronizer and to second passageways connected to the chambers and to the cylinder assemblies for controlling and providing synchronized movement of the at least two lift cylinder assemblies. The hydraulic circuit includes valving for an automatic re-synchronization cycle, fill cycle, and air purge cycle.

20 Claims, 12 Drawing Sheets

U.S. PATENT DOCUMENTS 5,320,047 A 6/1994 Deurloo et al.
5,390,586 A 2/1995 Jones
6,026,934 A 2/2000 Deurloo
6,408,736 B1 6/2002 Holt et al.
2003/0140628 A1 7/2003 Gai
2004/0020197 A1 2/2004 Cray

* cited by examiner

HYDRAULIC SYSTEM FOR SYNCHRONIZED EXTENSION OF MULTIPLE CYLINDERS

This application claims benefit under 35 USC 119(e) of provisional application Ser. No. 60/543,068, filed Feb. 9, 2004, entitled HYDRAULIC SYSTEM FOR SYNCHRONIZED EXTENSION OF MULTIPLE CYLINDERS, the entire contents of which are incorporated herein in their entirety.

BACKGROUND

The present invention relates to a hydraulic system for synchronized extension of multiple cylinders. For example, the present invention is useful on a lift table where table surface must be raised and/or lowered while maintaining levelness, despite non-uniform loads. However, the present apparatus is not believed to be limited to only this particular application, since distribution of identical amounts of hydraulic fluid can be used very effectively in many different applications. Also, the present invention includes additional aspects, including an automatic resynchronization sequence, a filling sequence without the need to draw, bleed, or to evacuate hydraulic lines, and an air purge sequence also without the need to draw a vacuum or bleed hydraulic lines.

Many attempts have been made to synchronize hydraulic systems in the past. Generally these synchronizing systems use multiple gear pumps on a common shaft, one for each cylinder, or special proportioning valves, or other means in an attempt to deliver an identical amount of hydraulic oil to each cylinder. None of these systems are completely successful because loss of oil in the various devices accumulate and adversely affect synchronization. For example, the gear units have losses around the sides of the gears and through the gear tooth surfaces. The systems using proportioning valves also experience oil loss because of the clearance between the valve body and the spool. Oil leaks and entrapped air and non-uniform loading also adversely affect synchronization and cause dissimilar extension of cylinders.

The loss of oil in any individual cylinder circuit especially hinders the functionality of the multi-cylinder system to move or lift objects in the intended even manner. Generally the loss of oil is a function of a number of operating cycles and the load applied to the cylinders. The worst case is demonstrated when the load is not evenly distributed between all of the cylinders being used. If a higher percentage of the load is assigned to one of the cylinders, then the leakage found in that cylinder circuit will be greater in volume than the leakage in the rest of the circuits. Over time, the higher leakage in one of the cylinder systems will cause the lifting cylinders to go out of phase and subsequently cause the system to fail. Also, many synchronized hydraulic systems that use multiple cylinders in parallel will bind and cause stress concentrations leading to premature wear and increased maintenance.

Resynchronization and line-purging to eliminate trapped air in known synchronized hydraulic systems is undesirably time-consuming and labor-intensive, and is difficult to accomplish without messy maintenance procedures such as disconnecting, bleeding, and reconnecting hydraulic lines. Further, repeated disconnections and re-connections undesirably increase the risk of new leaks.

Thus, an apparatus having the aforementioned advantages and solving the aforementioned problems is desired.

SUMMARY OF THE PRESENT INVENTION

In one aspect of the present invention, an apparatus for lifting an object while maintaining levelness of a support surface includes at least two lift cylinder assemblies adapted to be connected to the support surface for lifting and lowering the support surface, and a synchronizer. The synchronizer includes at least two isolated chambers corresponding to the at least two lift cylinder assemblies, a rod extending axially through the chambers, and pistons mounted on the rod with one of the pistons being located in each of the isolated chambers. The chambers include first and second passageways extending into opposite ends of each of the chambers. An axial passageway extends continuously through the rod and is connected to the first passageways for communicating hydraulic fluid to each first passageway. The device includes a hydraulic pump, and further includes a hydraulic circuit operably connecting the pump to the axial passageway of the synchronizer and to the second passageways of the synchronizer and to the at least two lift cylinder assemblies for controlling and providing synchronized movement of the at least two lift cylinder assemblies.

In another aspect of the present invention, a synchronizer is provided for a hydraulic circuit, where the hydraulic circuit is adapted to operate an apparatus to lift a support surface while maintaining levelness of the support surface using at least two lift cylinder assemblies connected to the support surface for lifting and lowering the support surface, and which are connected to a hydraulic pump. The synchronizer includes an assembly having at least two isolated chambers corresponding to the at least two lift cylinder assemblies, a rod extending axially through the chambers, and pistons mounted on the rod and located in associated ones of the isolated chambers. The chambers include first and second passageways extending into opposite ends of each of the chambers. An axial passageway extends continuously through the rod and connected to the first passageways for communicating hydraulic fluid to each first passageway. A hydraulic circuit connected to the axial passageway and the second passageway is provided that is adapted to operably connect the pump to the axial passageway of the synchronizer and to the second passageways of the synchronizer and to the at least two lift cylinder assemblies for controlling and providing synchronized movement of the at least two lift cylinder assemblies.

In another aspect of the present invention, a hydraulic circuit includes at least two lift cylinder assemblies adapted for connection to a support surface for lifting and lowering the support surface. A synchronizer is provided having at least two isolated chambers corresponding to the at least two lift cylinder assemblies, a rod extending axially through the chambers, and pistons mounted on the rod and located in associated ones of the isolated chambers. The circuit further includes a hydraulic pump, and a hydraulic circuit operably connecting the pump to the synchronizer and to the at least two lift cylinder assemblies for controlling and providing synchronized movement of the at least two lift cylinder assemblies, the hydraulic circuit being configured to provide an automatic synchronization of the at least two lift cylinder assemblies to realign the at least two lift cylinder assemblies relative to each other and to the synchronizer without disconnection of any hydraulic lines in the hydraulic circuit.

In another aspect of the present invention, a hydraulic apparatus includes at least two lift cylinder assemblies adapted for connection to a support surface for lifting and lowering the support surface. A synchronizer is provided having at least two isolated chambers corresponding to the at least two lift cylinder assemblies, a rod extending axially through the chambers, and pistons mounted on the rod and located in the isolated chambers. The circuit further includes a hydraulic pump, and a hydraulic circuit operably connecting the pump to the synchronizer and to the at least two lift cylinder assemblies for controlling and providing synchronized movement of the at least two lift cylinder assemblies, the hydraulic circuit including hydraulic fluid and including a valving arrangement configured to automatically purge air entrapped in the hydraulic fluid without disconnection of any hydraulic lines and without evacuation or bleeding of the hydraulic lines.

In another aspect of the present invention, a hydraulic apparatus includes at least two lift cylinder assemblies adapted for connection to a support surface for lifting and lowering the support surface. A synchronizer is provided having at least two isolated chambers corresponding to the at least two lift cylinder assemblies, a rod extending axially through the chambers, and pistons mounted on the rod and located in the isolated chambers. The circuit further includes a hydraulic pump, and a hydraulic circuit operably connecting the pump to the synchronizer and to the at least two lift cylinder assemblies for controlling and providing synchronized movement of the at least two lift cylinder assemblies. A valving arrangement is operably connected to the hydraulic circuit that, when actuated, automatically synchronizes the at least two lift cylinder assemblies to each other and to the synchronizer.

In another aspect of the present invention, a synchronizer for a hydraulic circuit is provided, where the hydraulic circuit is adapted to deliver proportionate amounts of hydraulic fluid to lift cylinder assemblies. The synchronizer includes a synchronizer assembly having a plurality of isolated chambers that are longitudinally aligned and that are adapted for connection to a hydraulic supply and to associated lift cylinder assemblies, the isolated chambers including a first isolated chamber at one end, one or more intermediate isolated chambers, and a second isolated chamber at its other end. A mechanical subassembly includes a piston in each of the isolated chambers and a plurality of rods connecting each of the pistons to an adjacent one of the pistons with the rods forming a continuous column of support. The synchronizer assembly includes a first end plate on the one end, a second end plate on the other end, and one or more intermediate end plates located between the isolated chambers, the end plates each including one or more structural sides defining ends of the associated isolated chambers. The rods and pistons of the mechanical assembly have dimensions that, when hydraulically moved to the one end, cause the piston in the one isolated cylinder to bottom out against the one end plate with the remaining pistons not bottoming out, such that the column of support is supported against the structural side of the one end plate. The dimensions of the mechanical assembly further, when hydraulically moved to the other end, cause the piston in the associated other isolated cylinder to bottom out against the other end plate with the remaining pistons not bottoming out, such that the column of support is supported against the structural side of the other end plate. By this arrangement, forces of stress on the mechanical subassembly are primarily compressive and not tensile stress when the mechanical subassembly is extended with hydraulic force against the pistons fully in either direction.

Methods related to the above are also believed to be novel, useful, unobvious, and hence patentable.

These and other aspects, objects, and features of the present invention will be understood and appreciated by those skilled in the art upon studying the following specification, claims, and appended drawings.

BRIEF DESCRIPTION OF DRAWINGS

FIGS. 11A–11B combine to form a side cross-sectional view of the rod assembly of FIGS. 10A–10B.

FIGS. 12A–12C combine to form a hydraulic drawing of a modified apparatus similar to that of FIGS. 1A–1C and also embodying the present invention; and FIG. 13 is a cross sectional view of a T-connector with orifice restricting oil flow therethrough.

DETAILED DESCRIPTION OF PREFERRED EMBODIMENTS

The present apparatus 10 (also called a "hydraulic system" herein) (FIGS. 1A–1B) includes a hydraulic circuit and components that achieve full and reliable synchronous operation of multiple (single and/or double acting) hydraulic cylinders. In the illustrated system, the cylinders used have similar areas in order to provide synchronized identical stroke actions.

Figure 1A:
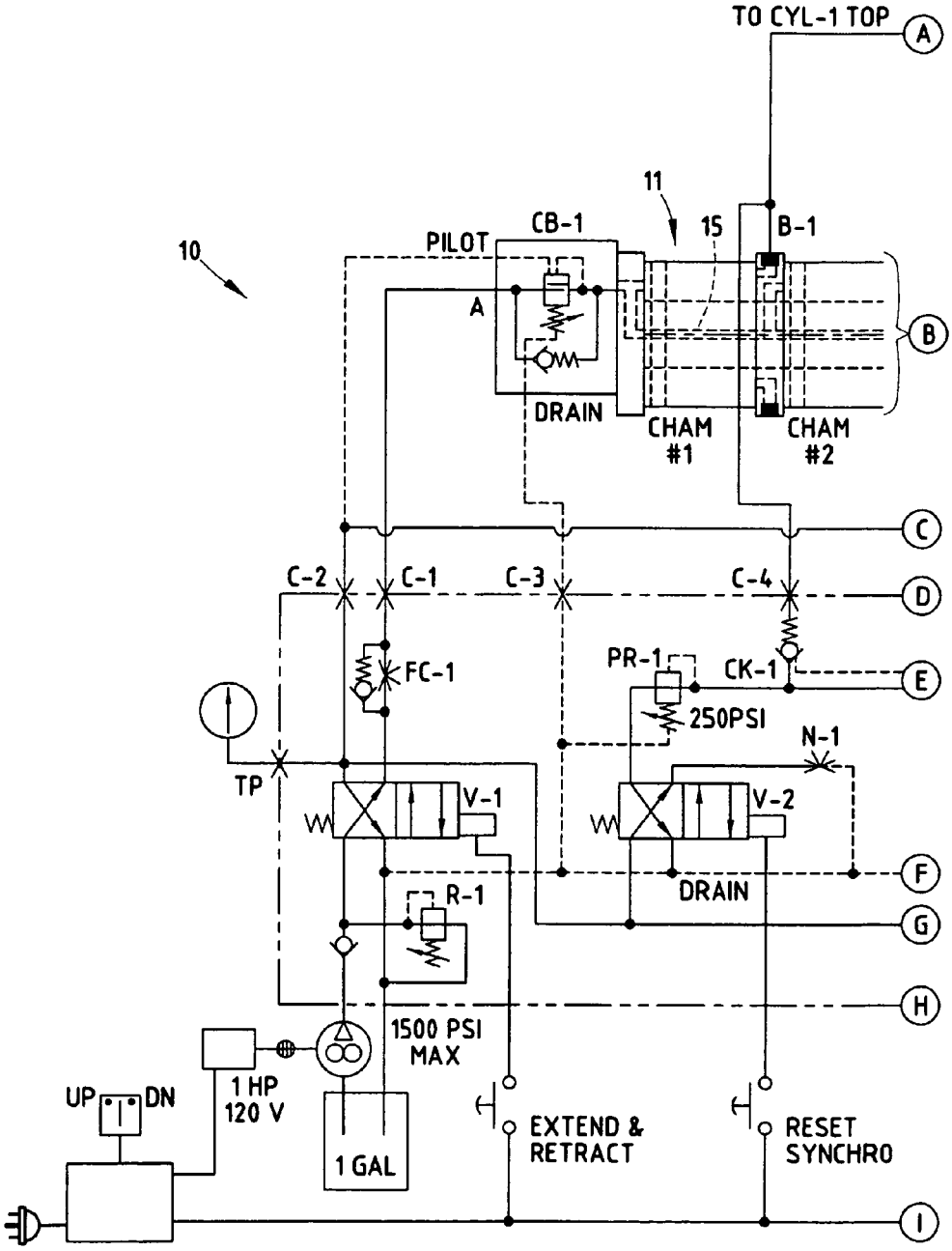
FIGS. 1A–1C combine to form a hydraulic drawing of an apparatus including a lift table, four lift cylinders, one at each corner, a synchronizer, a pump, and related hydraulic lines and valving arrangement embodying the present invention.
Figure 1B:
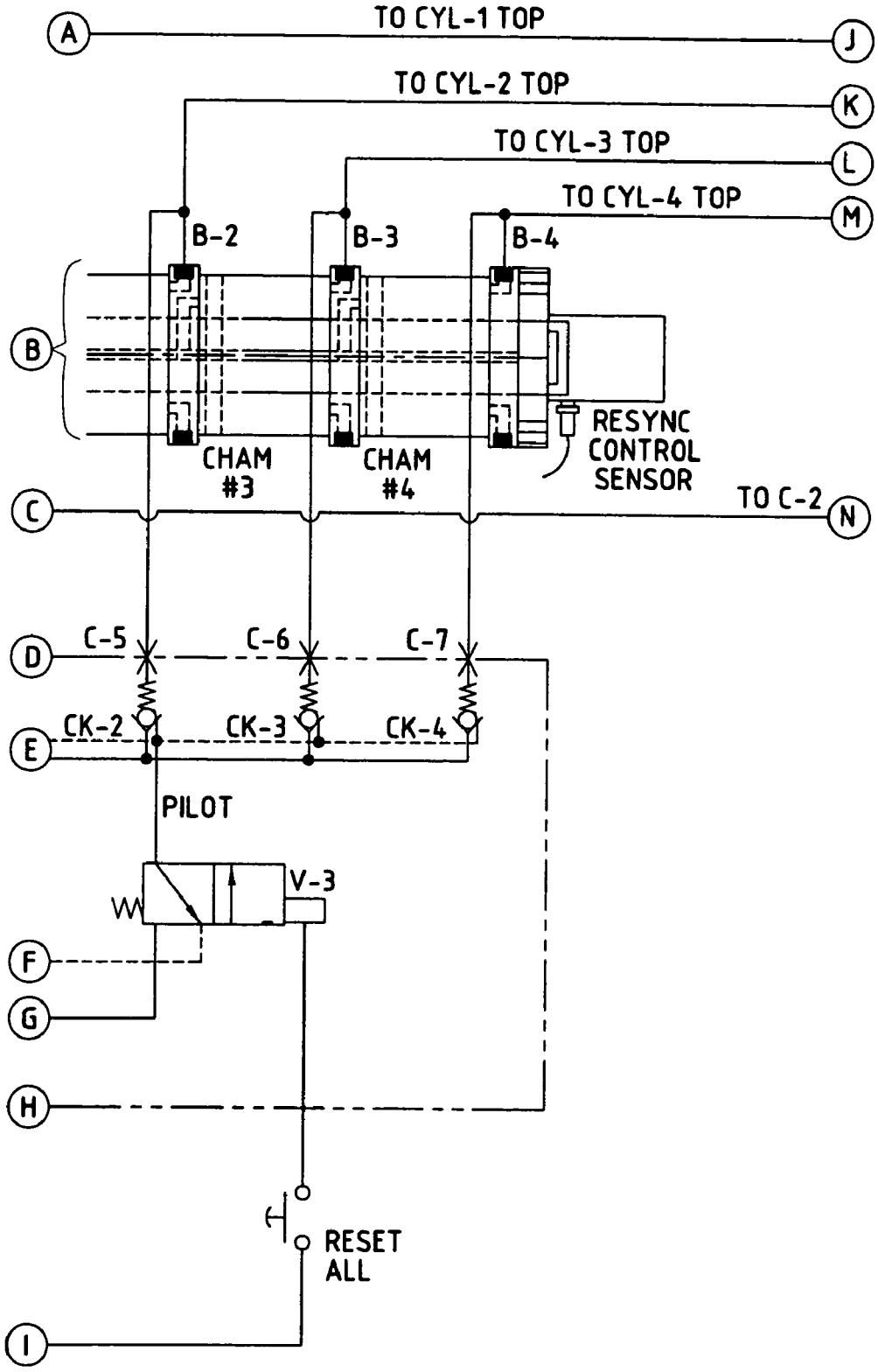
Figure 1C:
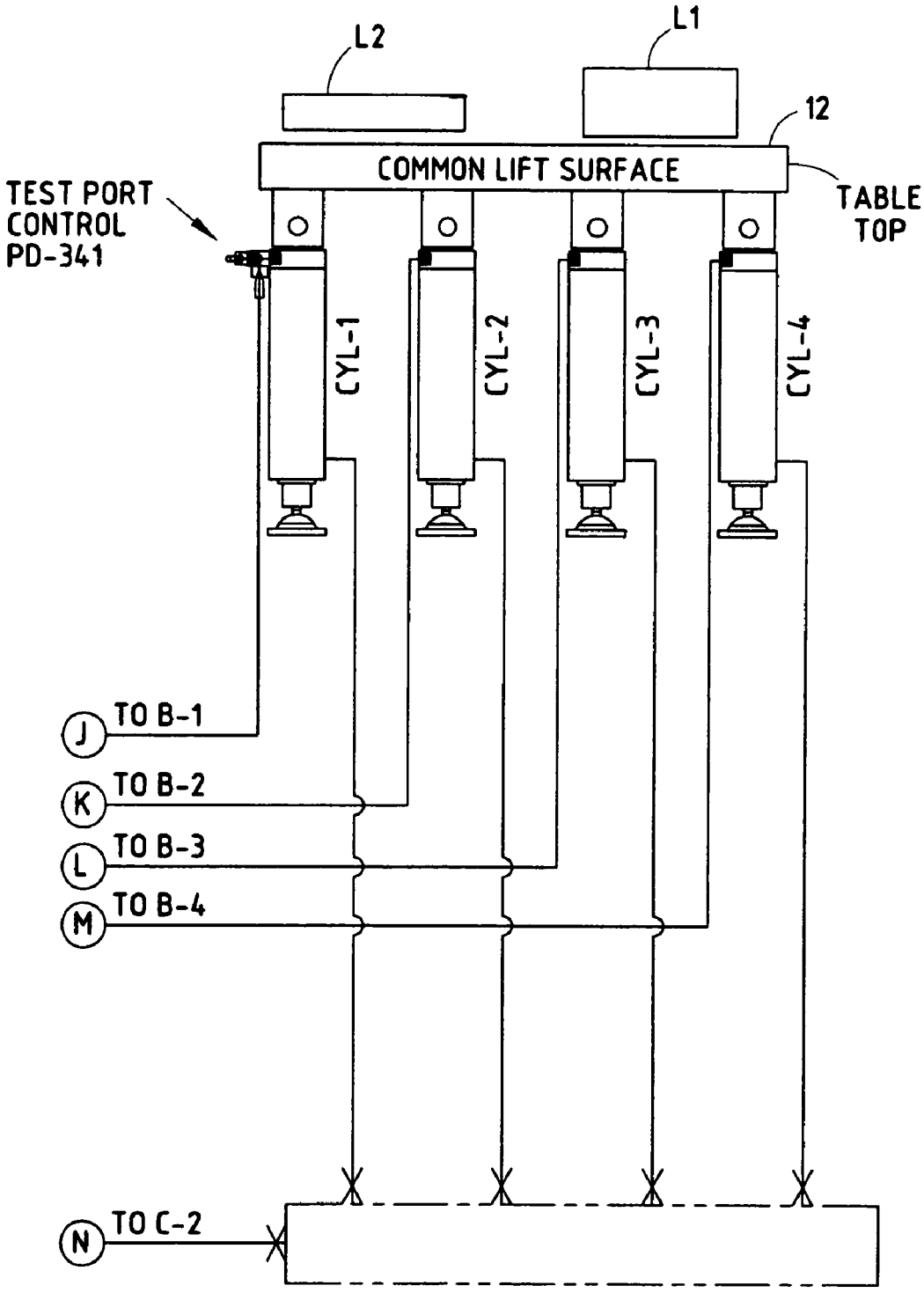

The illustrated apparatus 10 (FIGS. 1A–1C) includes four cylinders CYL-1, CYL-2, CYL-3, CYL-4 for lifting a table having a support surface 12 uniformly in a level manner without binding, even where there is an unbalanced load such as a heavier load L1 in one location and a lighter load L2 in another location on the table or lift surface. The apparatus 10 includes a synchronizer 11 having four chambers CHAM#1–CHAM#4 operably connected to a top of each of the cylinders CYL-1–CYL-4 by individual hydraulic lines. The synchronizer 11 includes a supply-side end plate, and a series of (four) cylinder walls and (three) intermediate end plates and another end plate that define the chambers CHAM#1–CHAM#4. A series of rods and piston heads are threaded together to define a stacked arrangement, with a piston head being located in each chamber CHAM#1–CHAM#4, and a rod extending through each of the four end plates. Solenoid valves V-1, V-2, and V-3, control valve CB-1, and various pressure regulators R-1, PR-1, flow control restrictors FC-1, and check valves CK-1, CK-2, CK-3, CK-4 are interconnected as shown in FIGS. 1A–1B to accurately control a balanced hydraulic fluid flow to and from each of the cylinders. Further, the arrangement allows automatic re-synchronization and air purging, as discussed below.

The attached circuit design addresses the above problems by creating a very robust system and providing a means of restoring the system if synchronization fails. In this example (4) four hydraulic cylinders are used, however any number of cylinders could be used. The system can also be sized to accommodate larger or smaller diameter cylinders, and differently sized cylinders. The illustrated cylinders #1 through #4 have a 2 inch bore and each has an area 3.1416 square inches. These cylinders are very heavy construction with very large rods and are equipped with heavy-duty seals. The operating clearances are minimized to prevent side movement, which is a prerequisite for use in machine lift table applications. The desired stroke in this example is 12 inches. It requires 37.69 cubic inches of oil for the desired stroke of each cylinder. A flexible hose connects each 2-inch cylinder with one of the chambers marked #1 through #4 of a synchronizing device. The lift surface (FIG. 1B) can have bottom brackets attached to the outer cylinder casings, or can have brackets welded directly to sides or ends of the cylinder casings, or can be attached in other ways known in the trade.

Figure 10A:
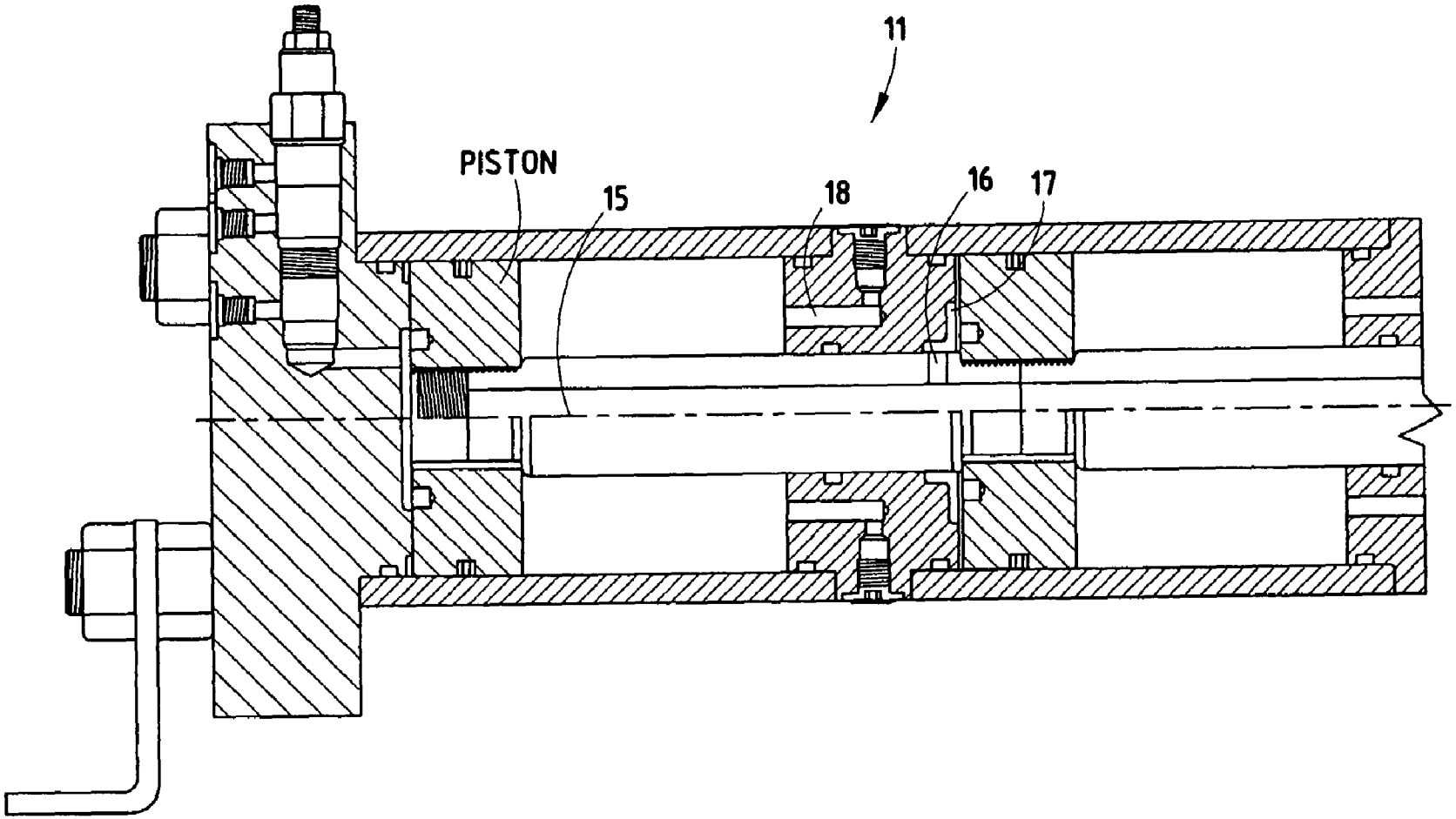
FIGS. 10A forms a partial side cross-sectional view of the synchronizer of FIG. 1.

The synchronizer 11 has four separate and isolated chambers with identical areas and volumes. The illustrated chambers are axially aligned, and are formed by cylinder side walls and end plates. The volume of each chamber is the amount required to furnish the 37.69 cubic inch of oil required by each attached 2-inch cylinder. Each chamber has a piston assembly and a piston rod. All of the piston rods are connected together, such as by threaded axial connection. The piston rods have an internal axial passageway 15 (FIGS. 10A–10B) that extends continuously through the assembled rods and first cross-drilled ports 16 extending from the axial passageway into each chamber, such as through a passageway 17 in the end plates. Second cross-drilled ports 18 extend from each chamber outwardly through the end plates. The first and second cross-drilled ports (FIGS. 1A and 1B) are operably connected to the hydraulic system to communicate hydraulic fluid into opposite sides of each piston. A step (FIG. 10A) is formed on the plates around a perimeter of each cavity, but spaced inwardly slightly from the radial edges of the cavity. The step does not act as a stop to limit movement of each piston against an end of the respective chambers, but does provide access and egress openings into each of the first and second ports that are always open for uniform inflow and outflow of hydraulic fluid.

The common piston rod (FIG. 10A) causes all of the piston assemblies to move together in linear axial fashion. Oil from a pressure source through port A is directed through a passageway 15 in the piston rods into all of the chambers. The cylinder assemblies will receive the oil and will be urged to move toward the opposite end of the chamber. The amount of motion and the speed of the motion will depend on the volume of oil being delivered from the pressure source. In the attached circuit design, if the piston assembly in chambers #1 through #4 (FIGS. 1A–1B) is in the at home position, 37.69 cubic in of oil will be located in each chamber. Each chamber has a connection to an individual cylinder through ports B1 through B4. If oil under pressure is introduced into the chambers through port A and the piston rod passageway then the piston assemblies moving under that pressure will force oil out of Port B of each chamber. The oil being forced out of the four chambers through the B ports will be equal in volume. The combination of pistons and interconnecting piston rods is dimensionally made to assure that internal pressure developed on the pistons in the synchro chamber, if the synchro is fully stroked, is always directed through the piston rods to the end piston against the end caps of the synchro and not in the middle chambers. The intent of this design is to prevent tension loads on the piston rod and threads. That idea and the heavy construction with very aggressive seals guarantee a long service life.

It will be understood by those skilled in the art that oil from a pressure source introduced into Port A is isolated, by the use of seals, from oil that flows in and out of Ports B1 through Port B4. It will also understood that by those skilled in the art that the hydraulic pressures in each chamber will be in equilibrium for balanced loads and will contribute to long seal life. The action of stopping the movement of the piston assembly by striking the end cap controls the volume of oil discharged from each chamber.

Operation of the system is as follows. In order to extend cylinders #1 through #4 the pump and motor must be operated. Oil from the pump is directed through normally open valve V-1 through port A of the counterbalance CB-1 and into Chamber #1. Oil enters the center hole in the piston rod in chamber #1 and then enters Chambers #2 through 4 through cross-drilled holes in the piston rod. Pressure and volume from the pump will cause the piston assemblies to stroke forward simultaneously. That action will cause oil to be discharged from the B Port of each chamber. Hose connections from the B Port of each chamber to the blind end of each 2-inch cylinder will cause the cylinder to begin to extend. In this example chamber #1 is connected to cylinder #1, etc. The extension rate and total stroke of each cylinder will be perfectly matched to the volume of oil received from each chamber of the synchronizer system. This action can raise or move an object using the uniform motion of the cylinders. Oil from the rod end of the cylinders will be directed to the system reservoir through the tank port of V-1.

The full stroke that is obtainable is, in this example, 12 inches. It is possible to stop the extension of the cylinders at any position less than 12 inches by stopping the pump. When the pump is stopped, oil that has been delivered to the cap end of the cylinders through the action of the synchronizer device will be prevented from returning by the counterbalance valve CB-1. The CB-1 valve prevents the cylinders from retracting and keeps the table at a selected level until a height change needs to be made.

To lower the table requires the hydraulic pump to be operated and V-1 to be energized. When this occurs, oil is directed to the rod end of the cylinders and to the pilot port of CB-1. The counterbalance valve will be forced to open and that action will allow oil from the cap end of the cylinders to flow into port B of the synchronizer. Load pressure from the cylinders #1 through #4 will force the piston assemblies in the synchronizer to reverse direction and force oil out of the A port. The cylinders will retract as long as V-1 and the pump motor are energized. The retract will stop quickly and hold the desired position if power is removed from those items.

Several additional features are provided that are required for proper operation of this system. V-2 and pressure regulator PR-1 are provided to furnish oil under pressure through the check valves to ports B1 through B4 on the synchronizer. This is used either during the initial start up of the system or if the system requires resynchronization. The circuit is intended to furnish oil to the four chambers making sure that the synchronizer is at the home position during the resynchronizing operation.

Valves V-3, and the pilot operated check valves are used to allow trapped air to be bled from the cylinders. This feature is useful during initial startup to purge the system of air or during resynchronization for the same purpose. Advantageously, this air purge can be done without having to evacuate the hydraulic lines and without having to draw a vacuum on the hydraulic lines and without having to bleed the lines. The plumbing connection is at the top of the system at the cap end of the cylinders. This high point is the most advantageous point to allow air to be purged from the system. The operation of V-3 directs oil to the pilot check valves. When the checks open, the four corner cylinders are allowed to bypass the synchronizer and to fully retract to home position. Oil that might contain air is directed from the cylinders to the system reservoir instead of to the synchronizer.

N-1 is a needle valve and is used to bleed oil from the pump circuit to balance the pump flow to the requirements of the system. In the design of the table lift system it is important that the cylinder rods be as large as possible for column strength. That feature causes a large area/volume difference between the cap end and the rod end of the cylinders. That large volume difference causes an unstable circuit condition to occur (e.g. hydraulic chatter). That problem is corrected by adjusting valve N-1 to achieve a smooth operation when the table is being lowered.

With the use of V-I, V-2, and V-3 in the proper sequence, the table lift system can be filled with oil and purged of air during the initial startup and resynchronized whenever it is required. This is an important feature that allows this system to be used long term successfully even though leakage might occur.

Hydraulic Lift Table Maintenance Procedures

For the original installation, the synchro unit and the power unit with the valve manifold block are all to be located according to a furnished plan, on the sheet metal drip pan base. All of these components when mounted to drip pan base form a common table control device for a wide range of tables, such as those adapted to provide up to 18,000 lb lift. Preferably, ¼ inch steel hydraulic tubing and good quality seal lock fittings should be used for all of the component interconnections. It is also preferable to use good shop practices, such as by keeping all components and lines clean, and by making all bends and tubing runs neat and orderly. Notably, the entire system can be assembled and plumbed on the bench for installation to a machine frame at a later date. The counterbalance valve located in the synchronizer should also be selected for the load. When all of the hydraulic connections have been made, the reservoir should be filled with hydraulic oil, and additive as required for the intended use.

Figure 2:
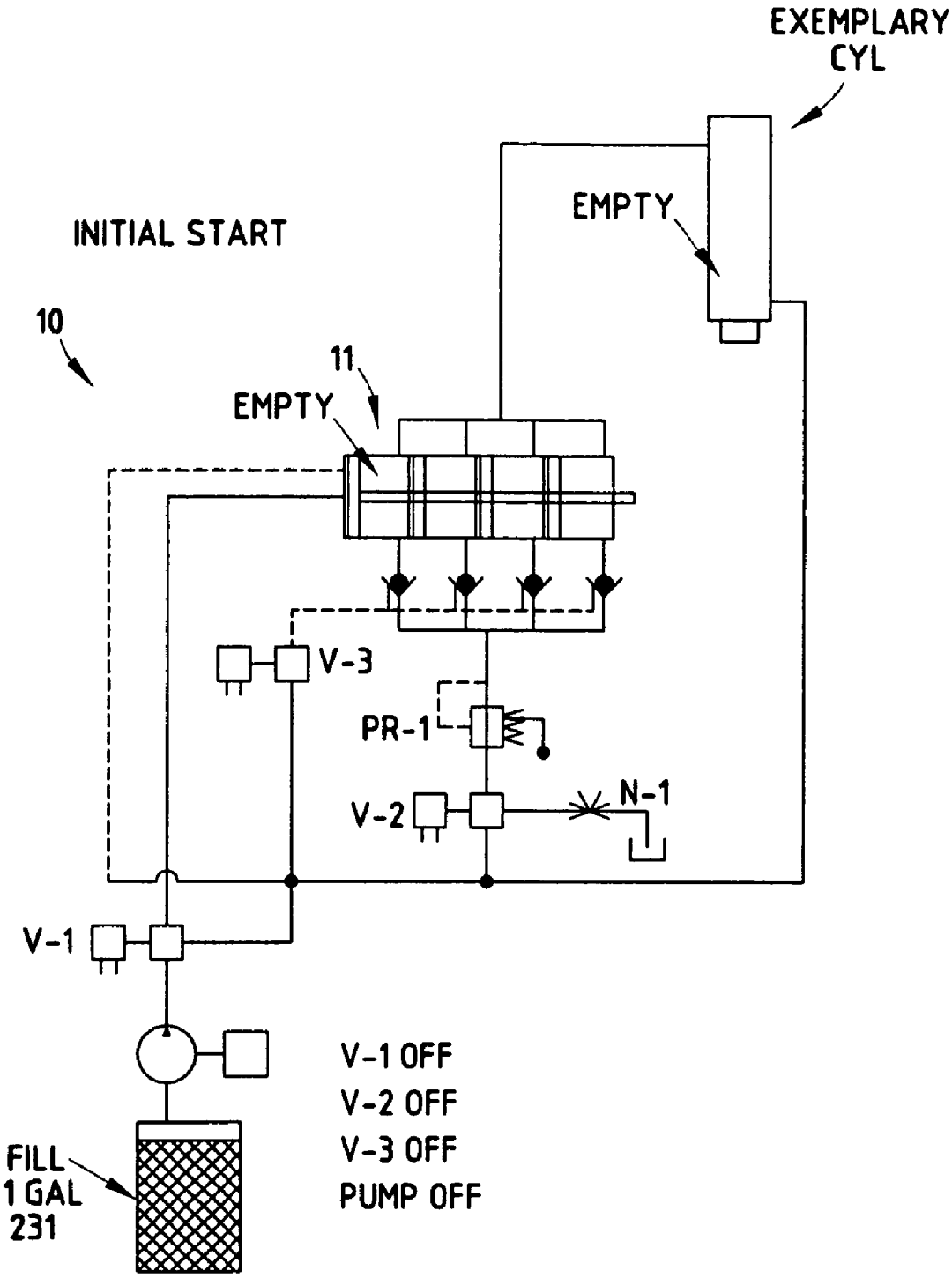
FIGS. 2–9 are hydraulic drawings showing the apparatus of FIG. 1 in various operative positions.
Figure 3:
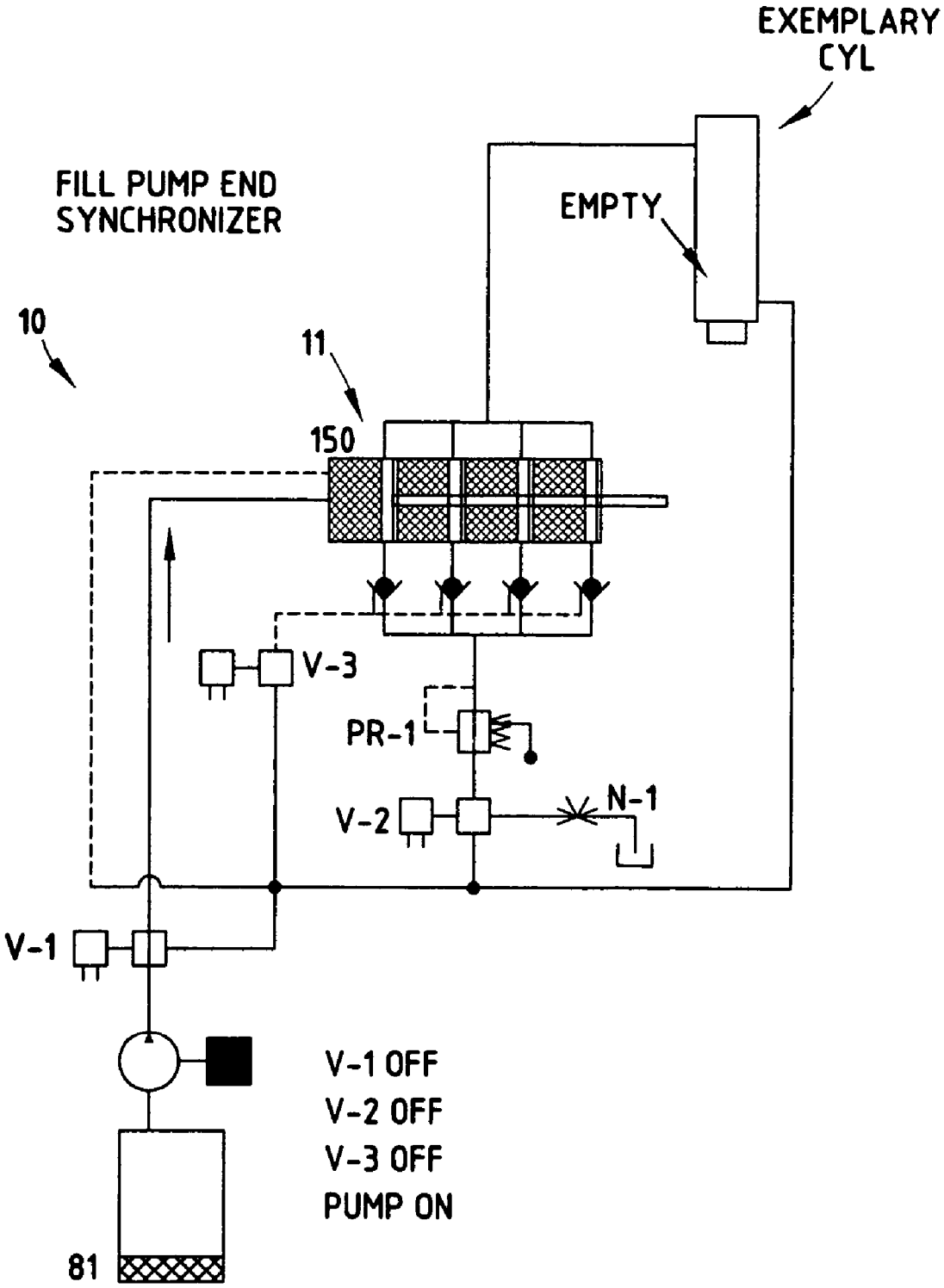

The following adjustments should be made before the pump is started (FIG. 2). Adjust the counterbalance valve to a maximum counterbalance relief setting (such as 1400 psi), and then adjust it downwardly to a desired load rating. Locate PR-1 on the valve block and remove the protective cap on the end of the valve. Locate the needle valve on the same block and turn it clockwise to close it. Snap a gauge on the test port (C-2) on the valve block and the cap end of the test cylinder. The power unit as delivered may be preset or adjusted as desired, such as to 1400 psi. Start the pump with V-1, V-2, V-3 off (FIG. 3). This will direct oil through the counterbalance valve into the synchro system. Keep the pump energized until the synchro is fully extended. Hold the pump on while adjusting the relief valve pressure as per the load table below. The table cylinders might begin to rise but that is not important at this junction.

When the synchro is fully extended and the pressure has been set, stop the pump. Energize V-2 and V-1, keeping V-3 off (FIG. 4), and then operate the pump. As you keep the pump on, check the cylinder gauge, and adjust PR-1 for 200 to 250 psi. Observe the movement of the synchronizer, and keep the pump on until the synchro is fully retracted. Verify the pump pressure setting.

Figure 5:
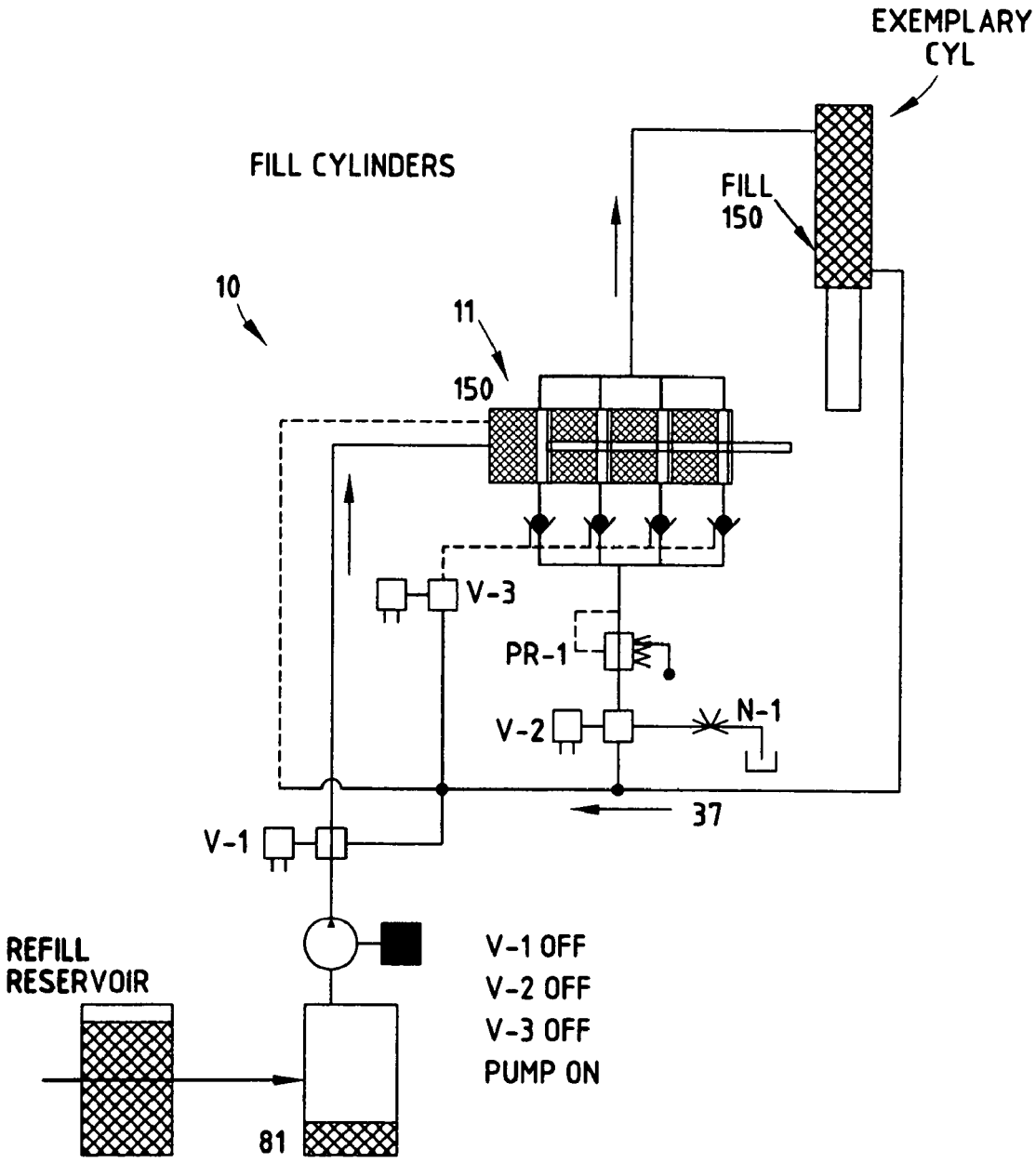

When the synchronizer has fully retracted, turn the pump off (FIG. 5). Turn off V-1 and V-2. Put the cap back on PR-1. The oil reservoir must be refilled at this point before proceeding. Now with V-1, V-2 and V-3 off, start the pump. That action will cause the synchro to advance directing oil to the cap ends of the four cylinders. Keep the pump on until the cylinders are fully extended approximately 12 inches, and turn the pump off.

Figure 6:
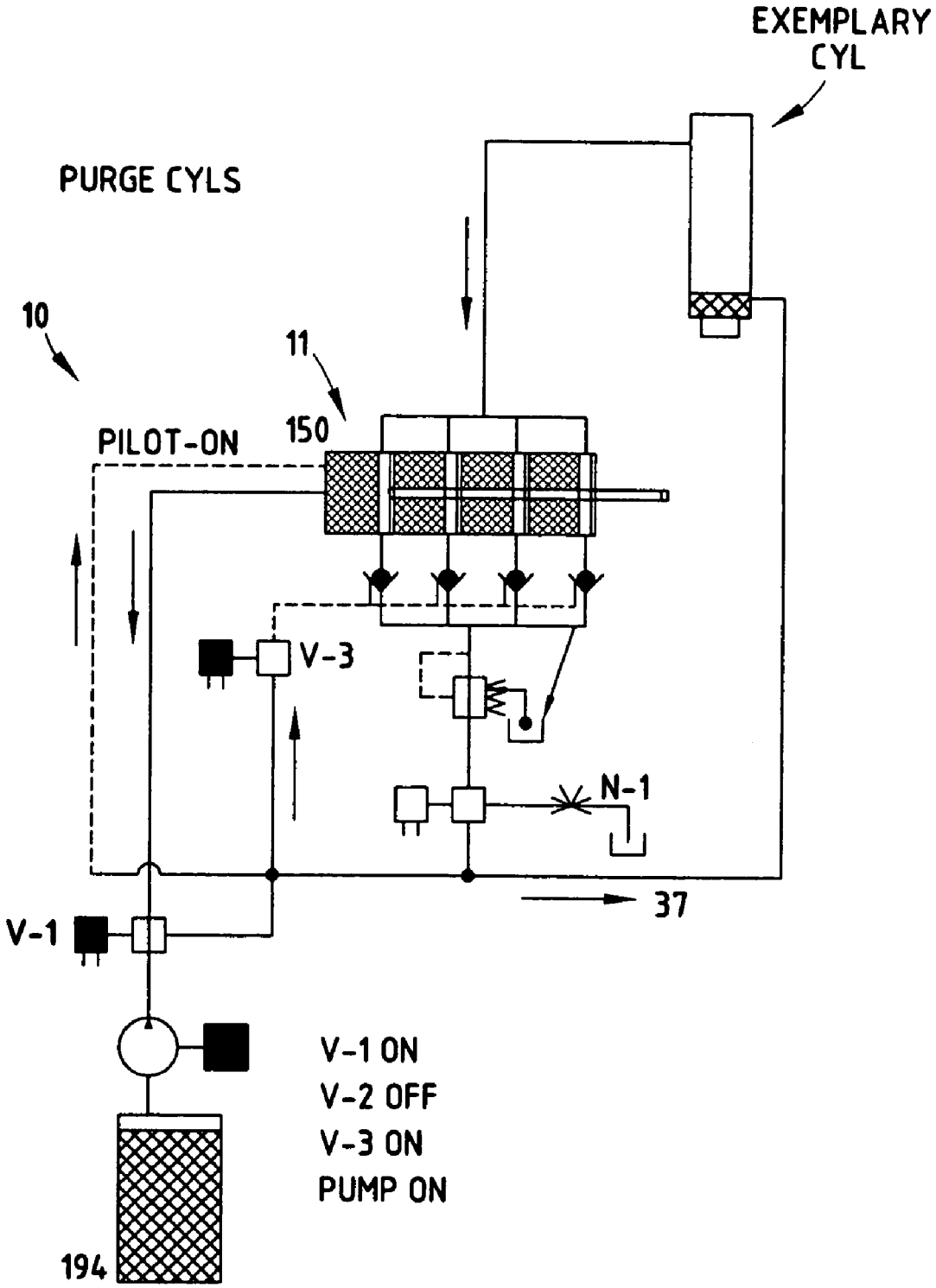

Energize V-1 and V-3 while leaving V-2 off, and turn on the pump (FIG. 6). This action will cause the table corner cylinders to retract. The synchro unit should not move while the cylinders retract. All of the oil that is in the four cylinders is being transferred back to the reservoir during this phase of the start-up procedure. The four cylinders might not retract at the same rate but that is ok. As soon as the cylinders are fully retracted shut off the pump.

Figure 7:
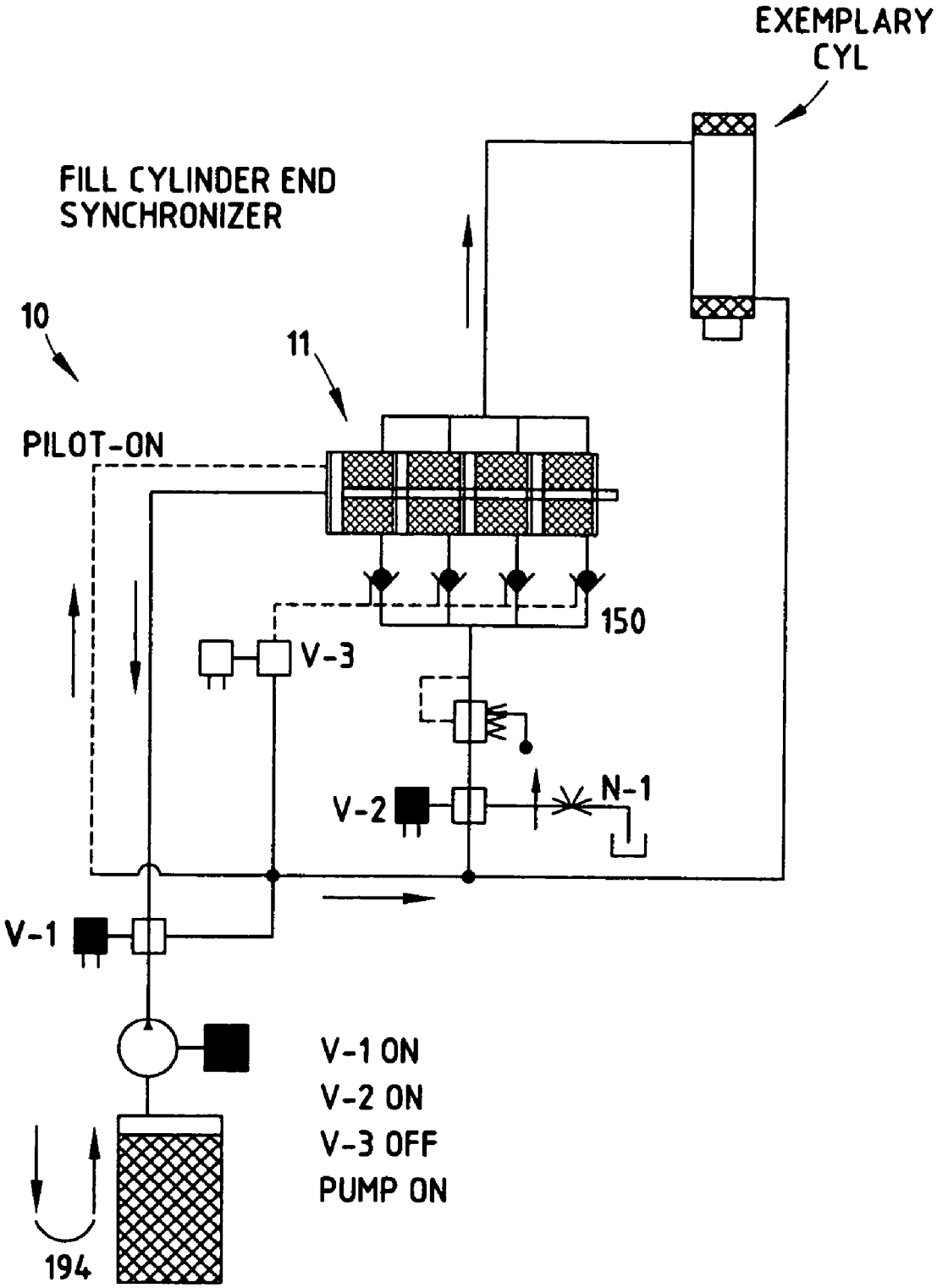

Turn V-3 off, energize V-2 and V-1, and operate the pump (FIG. 7). The synchro will retract to home position. Observe the gauge on the cap end of the cylinder. It should show the pressure setting of 200/250 psi. With the table completely down and the synchro at home position, check the fluid level in the reservoir. The level should be full.

Figure 8:
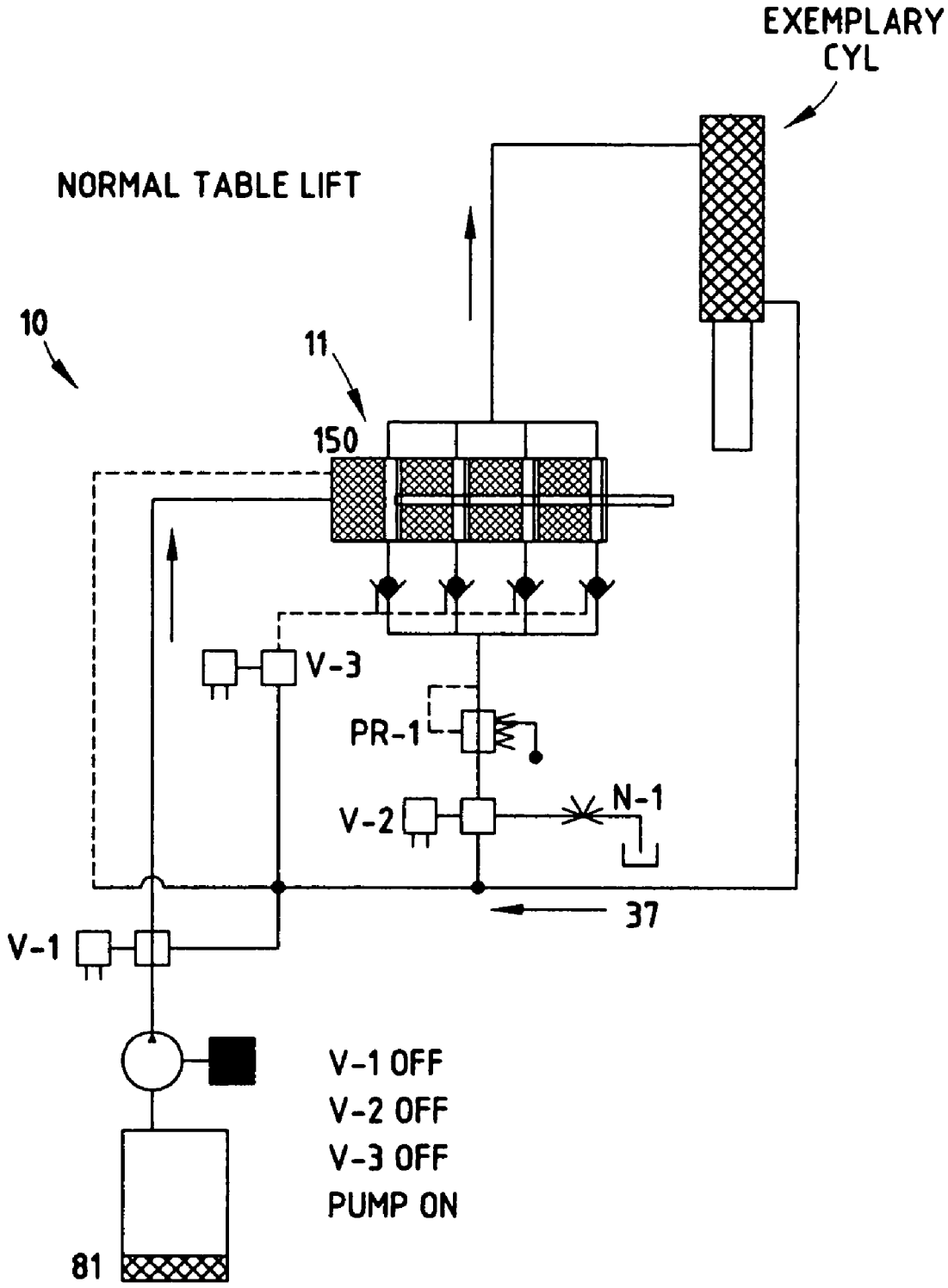

Operate the pump with all valves off to raise the table to the top of the stroke (FIG. 8). When the pump is stopped, the table should stay at that position.

Figure 9:
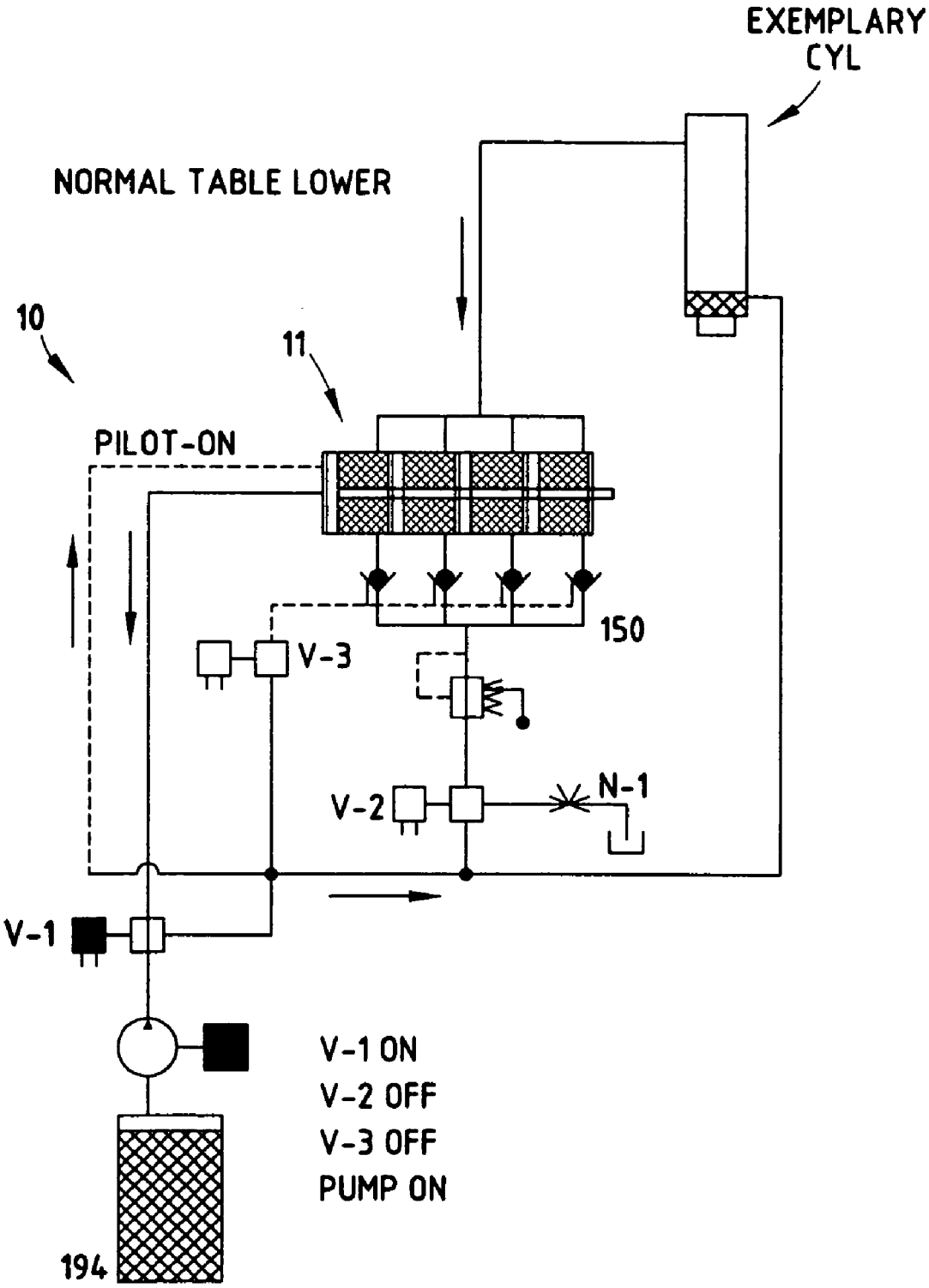

Operate V-1 and start the pump (FIG. 9). This will cause the table to retract. Adjust (N-1) as required per the chart below to obtain smooth no chatter operation of the system. Adjust the flow control on the power unit block for the table retract rate. The retract rate should be about the same as the 12 in/40 sec lift rate.

A prototype of the present lift system was constructed and it was adjusted to handle loads from 3000 lbs to 18000 lbs. The appropriate adjustments were as follows:

| Pump relief valve | Counterbalance | Needle valve* |
|---|---|---|
| 1500 psi for 18000 lb | ccw to the stop | 700/800 psi (C-2) port |
| 1200 psi for 12000 lb | cw one turn from stop | 650/550 psi (C-2) port |
| 800 psi for 10000 lb | same as above | 650/550 psi (C-2) port |
| 700 psi for 8000 lb | cw two turns from stop | 400/450 psi (C-2) port |
| 500 psi for 6000 lb | cw three turns from stop | 300/350 psi (C-2) port |
| 350 psi for 4000 lb | cw four turns from stop | close valve |
| 250 psi for 3000 lb | cw four one half from stop | close valve |

*The needle valve (N-1) should be adjusted for pressure low enough to give smooth operation but the (C-2) port pressure must be high enough to operate the counterbalance pilot allowing the synchronizer to function. Pilot pressure is in relation to the setting of the CB. Also, the pressure reducer (PR-1) should show about 300 psi max for heavy loads and about 150 for light loads. It can be adjusted as needed.

The normal operating condition is as follows. Initially, the table is down, corner cylinders fully retracted, valve-1, valve-2, and valve-3 off. To raise the table, start the pump (FIG. 8). Pressure is directed to the synchro causing the synchro to extend, that action will cause the corner cylinders to extend and the table to start going up. Operate the pump to achieve the desired table height then stop the pump. The table will stay at the desired height until a change is required.

To lower the table (FIG. 9), energize valve 1 and start the pump, with valve 2 and valve 3 remaining off. Pump pressure will release the counterbalance valve; pressure will also be directed to the rod end of the corner cylinders. The corner cylinders will begin to retract. Oil from the cap end of the corner cylinders will be directed to the synchro unit forcing the synchro to move toward home position. The table will be lowered and can be stopped at any desired position and will remain until a need arrives to again change the working level. Uneven lift or short lift height can be corrected as follows. If the table appears not to be synchronized, or cannot be raised to the intended height, the following steps should be taken. First, the operator should check around the machine for objects that are under the machine frame, and clear away anything that would prevent the machine from being lowered completely to the floor. The present hydraulic system allows the table to be at any height for this corrective operation to be done.

To resynchronize the unit, locate the resynchronize control and turn it on. The table will begin to retract. The table will retract at the normal rate until it reaches about 1½ inches from the bottom stop. The last 1½ inches will be faster than the normal rate while the correction action is taking place. The control function will automatically lower the table to the floor, and the system will be restored to correct operation with all cylinders and the synchro cylinder fully resynchronized. Since this synchronizing operation can be performed at any table height, the operator only needs to simply return the table to the operating height desired after this operation has been performed.

A cylinder may need to be changed if a problem is occurring on one corner of the table. The machine will need to be raised at least 30 inches to remove the cylinder from the frame member. The cylinder must be retracted for this operation. Disconnect the hydraulic lines and plug the fittings on the lines, to prevent contamination and loss of oil. Remove and replace any defective cylinder, including associated attachment components. After the fittings are carefully reinstalled, the table can be lowered to the floor. If the oil loss was minimized, by plugging the lines when the cylinder was exchanged, then minimal additional hydraulic oil will be required to make up the loss. Added oil can be put into the reservoir.

The table can be operated and the procedure outlined above should be followed to purge the cylinder of excessive air. The reservoir level should be checked and oil added as necessary. The resynchronization operation as outlined above can be repeated a number of times, to correct uneven lift, if required.

The principle of this system is that hydraulic fluid is contained in two or more closed loop systems that all function at the same time. One element of the closed loop system is a device with a number of chambers with connected pistons and the other element is an equal number of heavy-duty hydraulic cylinders. Each chamber is filled with fluid and each is connected to an individual cylinder. Any axial movement of either element in the connected pair will result in equal movement in the other element. This is essentially a master and slave system. If two or more of these chambers are assembled into a common package and the pistons are connected together by a common shaft, then an equal amount of fluid would be discharged from all of the chambers, if piston movement occurs. Very careful design and manufacturing control of the elements is required to create the equal volumes necessary for the synchronizing action to occur. A further consideration is that when the systems are initially filled with fluid any trapped air must expelled. A further consideration is that if any fluid is lost because of slight leakage, then some means must be available for fluid loss correction and restoration of the synchronizing function.

The table lift system design has a circuit that is provided to fill and purge the synchronizer chambers simultaneously, and also a separate circuit to allow the table lift cylinders to be fully retracted simultaneously. The description of these systems is as follows. Referring to the circuit drawing the following devices are used for these operations: V-1, V-2, V-3, CH-1, CK-2, CK-3, CK-4 and the pump motor.

Air Purge and Resynchronization

The operation of purging the system of air is as follows. Extend the cylinders to raise the table, if necessary (FIG. 8). The purge system will be effective only if the lift cylinders are extended 2 or more inches. This will allow for an exchange of fluid between the cylinders and the reservoir during step 2 below. If the cylinders are already extended, skip this step and go to step 2. With V-1, 2, 3 off, operate the pump/motor (FIG. 8). Oil will be directed through V-1 to port A on the synchronizer. Fluid from the synchronizer will be directed to the four cylinders and cause the cylinders to extend. Fluid from the rod ends of the cylinders will go to the reservoir through V-1.

Keep the pump energized until the cylinders are extended at least 3 inches. Stop the pump. At this point if the cylinders are extended 3 inches, then the synchronizer will also be extended about 0.875 inches from home position. The ratio between the illustrated cylinders and the synchro is approximately 3.43/1.

To purge the lift cylinders, energize V-1, V-3 and the pump/motor (FIG. 6). Pressure will be directed to the CB-1 pilot, the rod end of the four cylinders, through V-3 to the pilots of CK1 through 4, and through denergized V-2 through the needle valve N-1. N-1 serves as a flow divider and reduces the system pressure during the lift cylinder retraction operation. The pilot pressure directed to CK-1 through CK-4 will open the check valves and that action opens a circuit that allows fluid from the cap ends of the four cylinders to bypass the synchronizer chambers at ports B-1 through B-4 and go through PR-1 and denergized V-2 to the reservoir. Pressure at the pilot port on the counterbalance valve has opened the counterbalance valve allowing the synchro to retract to home position. The synchro unit will not move, however, because the oil from the cylinders has been redirected to the reservoir through PR-1. PR-1 is a relieving type of reducer and therefore allows the reverse flow, low pressure combination that allows the cylinders to retract without forcing the synchronizer to go to home position.

The four cylinders are constructed with the intent that when fully retracted very little area remains between the piston and the cylinder cap. Because of that fact practically all of the fluid and any trapped air is expelled to the reservoir during this operation. At this point with the cylinders retracted turn off the pump, V-1 and V-3. The cylinders are now retracted, however, the synchronizer remains extended. The oil from the cap end of the cylinders that normally forces the synchro to the home position was redirected to the reservoir.

In order to return the synchronizer to home position, energize V-1, V-2 and the pump/motor (FIG. 7). Fluid through V-2 will be switched from N-1 and sent to PR-1 instead. That will cause the system pressure to rise to the setting of R-1. Fluid will go from V-2 to PR-1 and then through the four check valves to the ports B-1 through B-4 on the synchronizer. Fluid will also be directed through the same port connection to the cap end of the four cylinders.

At this point, fluid is directed to the pilot on CB-1 and to the rod end of the four cylinders from the energized port of V-1 and because N-1 is closed off, that fluid is now the high pressure available from R-1 through V-1. The Cap end of the cylinders is receiving pressure from PR-1, the check valves and the ports on the synchro. Because the pressure at the rod end of the cylinders is higher than the reduced pressure from PR-1 at the cap end, the cylinders will not extend. The fluid that is directed to the ports B-1 through B-4, on the synchro unit will cause the synchro unit to fill with fresh oil from the pump unit, and, because CB-1 is held open by the pilot, the synchro will go to the home position. Keep the pump system energized long enough for the synchro to reach home.

These operations as described have allowed the system to be resynchronized by first allowing the cylinders to go to their natural retracted home position and then returning the synchro system to its home position. Although in this description of the system, it was stated that the lift cylinders should be raised about 3 inches, it could be done at any point, including full cylinder extension. For the resynchronization operation, however, there is no advantage for the cylinders to be extended beyond a few inches. Trapped air, if any, is always to be found at the cap end of the cylinders, and in theory, should be in the last 1 inch of cylinder stroke.

In actual practice, correcting the deficiencies in the lift system should not be required very often. Because of that fact, the required control circuit should only be accessible to qualified personnel and not the machine operator. In a normal production machine that has a hydraulic lift system, the three valves and pump are connected to a programmable controller and operated by timed program sequence. There is a proximity switch located to detect a projection on the synchro rod that triggers the synchro operation when the rod is retracting toward the home position. The proximity switch is positioned to start the synchro sequence during the last 1½ inches of cylinder retraction. This operation can be activated by the use of a synchro system restore switch when the cylinders are extended as much as 12 inches. The table will begin normal controlled ascent until the proximity switch is activated at 1½ inches and then the synchro operation will take place. This operation can be repeated as many times as required to make sure that the system is synchronized.

Figure 4:
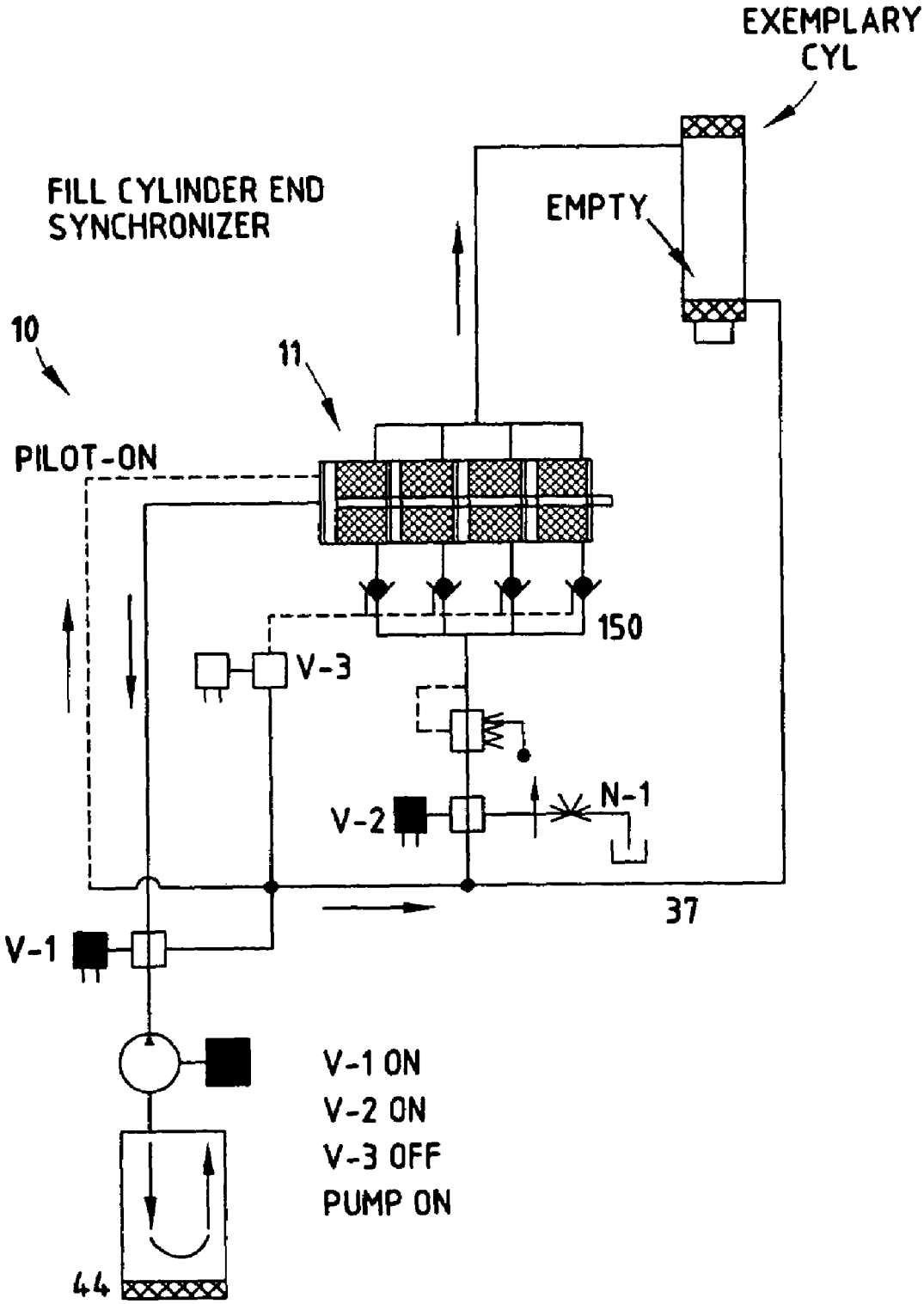

It is possible to utilize the valve arrangement previously described to fill the synchronizer and the cylinders with oil from the reservoir when the system is first started or the system requires a major repair. In this system, the reservoir has by design a large enough fluid capacity to hold all of the oil found in the multi-chambered synchronizer or the connected cylinders. Start by filling the reservoir full (FIG. 2). Operate the pump (FIG. 3). Oil will go through V-1 to the CB-1 port-A and cause the synchro to extend. Keep the pump on until the synchro is fully extended. Now the synchro chambers are filled on the pump side. Then, turn on V-1, V-2 and the pump (FIG. 4). This action will put pressure on the rod end of the cylinders. The cylinders are already retracted so they will not move. Pressure will be directed through V-2 and PR-1 and that will cause oil under reduced pressure to force the synchro to retract and be filled on the cylinder end of the synchro. In this operation oil from the pump end of the synchro chambers was forced back into the reservoir by the transfer operation immediately pumping the oil into the cylinder side of the synchro chambers.

The oil from the reservoir has now been stored in cylinder chambers of the reservoir. The reservoir is empty and must be refilled with oil. With all valves turned off, operate the pump (FIG. 5). Oil will be delivered to CB-1. Port A and the synchro will advance, forcing the stored oil out of the synchro chambers into the cap end of the cylinders. Keep the pump on until the cylinders are fully extended.

By turning on V-1, V-3, and the pump (FIG. 6), the oil from the cylinders will be delivered to the reservoir through the check valves. Keep the pump on until the cylinders are fully retracted. The synchro will remain extended. Turn on V-1, V-2 and the pump (FIG. 7). This action will put pressure on the rod end of the cylinders. The cylinders are already retracted so they will not move. Pressure will be directed through V-2 and PR-1 and the check valves and that will cause oil under reduced pressure to force the synchro to retract and be filled with oil in the cylinder chamber end of the synchro. The system is now ready to be placed into normal production.

MODIFICATION

A modified hydraulic system incorporating a synchronizer includes very similar components as the first-disclosed hydraulic system (FIGS. 1–10A). The components, features, and aspects of the modified hydraulic system are identified using the same number as the identical or similar numbers on the first hydraulic system, but with the addition of the letter "A". This is done to reduce redundant discussion, and to create a more easily understood discussion.

In the hydraulic system, the T-connectors B-1, B-2, B-3, and B-4 are modified to include a 0.030 inch restrictor orifice on each of their output passageways connected by hydraulic lines to the top of the cylinders CYL-1, CYL-2, CYL-3, CYL-4. The other two passageways of the T-connectors (i.e. the passageway to the various chambers on the synchronizer and the passageway leading to the output ends of the check valves CK-1, CK-2, CK-3, CK-4) are in fluid contact with each other without restriction. Testing has shown that this allows elimination of the flow control FC-1 in the system 10 shown in FIG. 1A, and potentially allows better control of the overall system in regard to synchronization and resynchronization. The hydraulic system also has its test ports relocated to the output connectors C-4, C-5, C-6, and C-7 of the check valves CK-1, CK-2, CK-3, and CK-4. In the system of FIG. 1A, the test ports were located at a top of the cylinders CYL-1, CYL-2, CYL-3, CYL-4.

It is to be understood that variations and modifications can be made on the aforementioned structure without departing from the concepts of the present invention, and further it is to be understood that such concepts are intended to be covered by the following claims unless these claims by their language expressly state otherwise.

I claim:

1. An apparatus for lifting an object while maintaining levelness of a support surface, comprising:

at least two lift cylinder assemblies adapted to be connected to the support surface for lifting and lowering the support surface;

a synchronizer having at least two isolated chambers corresponding to the at least two lift cylinder assemblies, a rod extending axially through the chambers, and pistons mounted on the rod with one of said pistons being located in each of the isolated chambers, the chambers including first and second passageways extending into opposite ends of each of the chambers; an axial passageway extending continuously through the rod and connected to the first passageways for communicating hydraulic fluid to each first passageway;

a hydraulic pump; and a hydraulic circuit operably connecting the pump to the axial passageway of the synchronizer and to the second passageways of the synchronizer and to the at least two lift cylinder assemblies for controlling and providing synchronized movement of the at least two lift cylinder assemblies.

2. The apparatus defined in claim 1, including a flat table surface attached to said lift cylinder assemblies.

3. The apparatus defined in claim 2, wherein the hydraulic circuit includes a main fluid line extending from each one of the isolated chambers to an associated one of the lift cylinder assemblies, and wherein each of the main fluid lines includes a restrictor orifice for restricting flow of hydraulic fluid to the associated one lift cylinder assembly.

4. The apparatus defined in claim 3, wherein the restrictor orifice is at most 0.030 inches in diameter.

5. The apparatus defined in claim 1, wherein the hydraulic circuit includes a pressure regulator counterbalance valve attached to an end of the synchronizer and operably connected to the axial passageway in the rod for regulating pressure of fluid flowing into the axial passageway.

6. The apparatus defined in claim 5, including a first control valve operably connected to the counterbalance valve for regulating the hydraulic fluid flowing to and from the counterbalance valve.

7. The apparatus defined in claim 6, including a second control valve operably connected to the second passageways in the isolated chambers in an arrangement bypassing the synchronizer, the second control valve being adapted to control hydraulic fluid flow to the second passageways and hence to the lift cylinder assemblies.

8. The apparatus defined in claim 1, wherein the hydraulic circuit operably connects the pump to the synchronizer and to the at least two lift cylinder assemblies for controlling and providing synchronized movement of the at least two lift cylinder assemblies, the hydraulic circuit including a valving arrangement configured to automatically purge air entrapped in the hydraulic fluid without disconnection of any hydraulic lines and without evacuation or bleeding of the hydraulic lines.

9. The apparatus defined in claim 1, wherein the valving arrangement is operably connected to the hydraulic circuit to, when actuated, automatically re-synchronize positions of the at least two lift cylinder assemblies to each other and to the synchronizer without disconnection of any hydraulic lines and without evacuation or bleeding of the hydraulic lines.

10. The apparatus defined in claim 1, wherein the isolated chambers include a first isolated chamber at one end, one or more intermediate isolated chambers, and a second isolated chamber at its other end;

a mechanical subassembly including the pistons in each of the isolated chambers and the rod, the rod being interconnected rod sections the connect the pistons to each other with the rods forming a continuous column of support;

the synchronizer assembly including a first end plate on the one end, a second end plate on the other end, and one or more intermediate end plates located between the isolated chambers, the end plates each including one or more structural sides defining ends of the associated isolated chambers;

the rod sections and pistons of the mechanical assembly having dimensions that, when hydraulically moved to the one end, cause the piston in the one isolated cylinder at the one end to bottom out against the one end plate with the remaining pistons not bottoming out, such that the column of support is supported against the structural side of the one end plate; and the dimensions of the mechanical assembly further, when hydraulically moved to the other end, causing the piston in the associated other isolated cylinder to bottom out against the other end plate with the remaining pistons not bottoming out, such that the column of support is supported against the structural side of the other end plate;

whereby, forces of stress on the mechanical subassembly are primarily compressive and not tensile stress when the mechanical subassembly is extended with hydraulic force against the pistons fully in either direction.

11. The synchronizer in claim 10, wherein the rod sections each include an axial bore that aligns with other of the axial bores to form the axial passageway.

12. The synchronizer in claim 11, wherein the rod sections further include radial bores that extend from the axial bores and that form the first passageways for communicating hydraulic fluid to at least one of the isolated chambers.

13. A synchronizer for a hydraulic circuit, where the hydraulic circuit is adapted to operate an apparatus to lift a support surface while maintaining levelness of the support surface using at least two lift cylinder assemblies connected to the support surface for lifting and lowering the support surface, and which are connected to a hydraulic pump, the synchronizer comprising:

an assembly having at least two isolated chambers corresponding to the at least two lift cylinder assemblies, a rod extending axially through the chambers, and pistons mounted on the rod and located in associated ones of the isolated chambers, the chambers including first and second passageways extending into opposite ends of each of the chambers; an axial passageway extending continuously through the rod and connected to the first passageways for communicating hydraulic fluid to each first passageway; and a hydraulic circuit connected to the axial passageway and the second passageway and that is adapted to operably connect the pump to the axial passageway of the synchronizer and to the second passageways of the synchronizer and to the at least two lift cylinder assemblies for controlling and providing synchronized movement of the at least two lift cylinder assemblies.

14. A hydraulic apparatus comprising:

at least two lift cylinder assemblies adapted for connection to a support surface for lifting and lowering the support surface;

a synchronizer having at least two isolated chambers corresponding to the at least two lift cylinder assemblies, a rod extending axially through the chambers, and pistons mounted on the rod and located in the isolated chambers;

a hydraulic pump; and a hydraulic circuit operably connecting the pump to the synchronizer and to the at least two lift cylinder assemblies for controlling and providing synchronized movement of the at least two lift cylinder assemblies, the hydraulic circuit including hydraulic fluid and including a valving arrangement configured to automatically purge air entrapped in the hydraulic fluid without disconnection of any hydraulic lines and without evacuation or bleeding of the hydraulic lines.

15. A hydraulic apparatus comprising:

at least two lift cylinder assemblies adapted for connection to a support surface for lifting and lowering the support surface;

a synchronizer having at least two isolated chambers corresponding to the at least two lift cylinder assemblies, a rod extending axially through the chambers, and pistons mounted on the rod and located in the isolated chambers;

a hydraulic pump;

a hydraulic circuit operably connecting the pump to the synchronizer and to the at least two lift cylinder assemblies for controlling and providing synchronized movement of the at least two lift cylinder assemblies; and a valving arrangement operably connected to the hydraulic circuit that, when actuated, automatically re-synchronizes positions of the at least two lift cylinder assemblies to each other and to the synchronizer without disconnection of any hydraulic lines and without evacuation or bleeding of the hydraulic lines.

16. A synchronizer for a hydraulic circuit, where the hydraulic circuit is adapted to deliver proportionate amounts of hydraulic fluid to lift cylinder assemblies, the synchronizer comprising:

a synchronizer assembly having a plurality of isolated chambers that are longitudinally aligned and that are adapted for connection to a hydraulic supply and to associated lift cylinder assemblies, the isolated chambers including a first isolated chamber at one end, one or more intermediate isolated chambers, and a second isolated chamber at its other end;

a mechanical subassembly including a piston in each of the isolated chambers and a plurality of rods connecting each of the pistons to an adjacent one of the pistons with the rods forming a continuous column of support;

the synchronizer assembly including a first end plate on the one end, a second end plate on the other end, and one or more intermediate end plates located between the isolated chambers, the end plates each including one or more structural sides defining ends of the associated isolated chambers;

the rods and pistons of the mechanical assembly having dimensions that, when hydraulically moved to the one end, cause the piston in the one isolated cylinder to bottom out against the one end plate with the remaining pistons not bottoming out, such that the column of support is supported against the structural side of the one end plate; and the dimensions of the mechanical assembly further, when hydraulically moved to the other end, causing the piston in the associated other isolated cylinder to bottom out against the other end plate with the remaining pistons not bottoming out, such that the column of support is supported against the structural side of the other end plate;

whereby, forces of stress on the mechanical subassembly are primarily compressive and not tensile stress when the mechanical subassembly is extended with hydraulic force against the pistons fully in either direction.

17. The synchronizer in claim 16, wherein the rods each include an axial bore that aligns with other of the axial bores to form a continuous passageway for hydraulic fluid extending longitudinally along the mechanical subassembly.

18. The synchronizer in claim 17, wherein the rods further include radial bores that extend from the axial bores for communicating hydraulic fluid to at least one of the isolated chambers.

19. An apparatus for lifting an object while maintaining levelness of a support surface, comprising:

a support surface having four corners;

four lift cylinder assemblies connected to each corner of the support surface for lifting and lowering the support surface while maintaining levelness of the support surface;

a synchronizer having four isolated chambers corresponding to each of the four lift cylinder assemblies, a rod extending axially through the chambers, and pistons mounted on the rod with one of said pistons being located in each of the isolated chambers, the chambers including first and second passageways extending into opposite ends of each of the chambers; an axial passageway extending continuously through the rod and connected to the first passageways for communicating hydraulic fluid to each first passageway;

a hydraulic pump; and a hydraulic circuit operably connecting the pump to the axial passageway of the synchronizer and to the second passageways of the synchronizer and to the at least two lift cylinder assemblies for controlling and providing synchronized movement of the at least two lift cylinder assemblies; the hydraulic circuit including a pressure regulator counterbalance valve connected to the synchronizer and to the axial passageway for regulating hydraulic fluid pressure within the synchronizer; the hydraulic circuit including first and second control valves controlling flow of hydraulic fluid to the synchronizer and away from the four lift cylinder assemblies and to drain, and including a third control valve controlling flow of hydraulic fluid to drain when back pressure is created against hydraulic fluid on both sides of the four lift cylinder assemblies.

20. The apparatus defined in claim 19, wherein the hydraulic circuit includes a restrictor orifice of about 0.030 inches diameter connected to a line extending from the synchronizer to each of the four lift cylinder assemblies.

* * * * *